US007479936B2

(12) United States Patent
Park

(10) Patent No.: US 7,479,936 B2
(45) Date of Patent: Jan. 20, 2009

(54) PLASMA DISPLAY AND ITS DRIVING METHOD AND CIRCUIT

(75) Inventor: Su-Jin Park, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 317 days.

(21) Appl. No.: 11/511,271

(22) Filed: Aug. 29, 2006

(65) Prior Publication Data

US 2007/0085768 A1 Apr. 19, 2007

(30) Foreign Application Priority Data

Oct. 18, 2005 (KR) ..... 10-2005-0098062

(51) Int. Cl.
*G09G 3/28* (2006.01)

(52) U.S. Cl. ..... 345/60; 345/62; 345/67

(58) Field of Classification Search ..... 345/60, 345/61, 62, 63, 67, 68, 204, 211; 315/169.3, 315/169.4

See application file for complete search history.

(56) References Cited

U.S. PATENT DOCUMENTS

| | | | | |
|---|---|---|---|---|
| 7,176,854 | B2 * | 2/2007 | Lee et al. | 345/60 |
| 7,348,940 | B2 * | 3/2008 | Cho et al. | 345/66 |
| 2005/0140588 | A1 | 6/2005 | Lee et al. | |

FOREIGN PATENT DOCUMENTS

| | | |
|---|---|---|
| CN | 1612190 | 5/2005 |
| JP | 2003-255885 | 9/2003 |
| KR | 10-2001-0083658 | 9/2001 |
| KR | 10-2003-0027173 | 4/2003 |
| KR | 10-2003-0090370 | 11/2003 |
| KR | 10-2004-0088944 | 10/2004 |

OTHER PUBLICATIONS

European Search Report corresponding to European Patent Application No. 06121708.9, issued on Aug. 31, 2007.

* cited by examiner

*Primary Examiner*—David Hung Vu
(74) *Attorney, Agent, or Firm*—Robert E. Bushnell, Esq.

(57) ABSTRACT

A plasma display has a first power recovery unit including a first inductor having a first end coupled to a second electrode and a second power recovery unit including a second inductor having a first end coupled to the second electrode, the second inductor having an inductance different from that of the first inductor and alternately supplying a second voltage that is greater than a first voltage and a third voltage that is less than the first voltage to the second electrode, while the first voltage is supplied to the first electrode, during a sustain period. A first path between the first inductor and second electrode has a different length from that of a second path between the second inductor and the second electrode, and an inductor on a longer path among the first and second paths has a smaller inductance than that of an inductor on a shorter path among the first and second paths. When the inductance of the inductor on the longer path of the two power recovery circuit paths is set to be relatively smaller, the impedance can be compensated for by the parasitic inductances on the longer path.

15 Claims, 8 Drawing Sheets

PLASMA DISPLAY AND ITS DRIVING METHOD AND CIRCUIT

CLAIM OF PRIORITY

This application makes reference to, incorporates the same herein, and claims all benefits accruing under 35 U.S.C. §119 from an application for PLASMA DISPLAY DEVICE AND DRIVING METHOD THEREOF earlier filed in the Korean Intellectual Property Office on the 18th of Oct. 2005 and there duly assigned Serial No. 10-2005-0098062.

BACKGROUND OF THE INVENTION

1. Field of the Invention

The present invention relates to a plasma display and its driving method and circuit.

2. Description of the Related Art

A plasma display includes a Plasma Display Panel (PDP) that uses a plasma generated by a gas discharge to display characters or images. Such a PDP includes, according to its size, more than several tens to millions of pixels (discharge cells) arranged in the form of a matrix.

The plasma display is driven by a plurality of subfields, which are divided from a frame and have respective weight values. In addition, each subfield has a reset period, an address period, and a sustain period. The reset period is for initializing the discharge cells so that the next addressing can be stably performed. The address period is for selecting turn-on/turn-off discharge cells (i.e., cells to be turned on or off). In addition, the sustain period is for causing a sustain discharge for displaying an image on the addressed discharged cells.

In order to perform such operations, a sustain pulse alternately having a high-level voltage (voltage Vs) and a low-level voltage (0V) is supplied in inverse phases to the scan and sustain electrodes during the sustain period, and reset and scan waveforms are supplied to the scan electrodes during the reset and address periods. Therefore, a scan driving board for driving the scan electrodes and a sustain driving board for driving the sustain electrodes are separately needed, and in this case, a problem of mounting the driving boards on a chassis base can occur, and the cost increases because of the separate driving boards.

Therefore, for combining the two driving boards into a single combined board, schemes of providing the single board to an end of the scan electrodes and extending an end of the sustain electrodes to reach the combined board have been proposed. However, when the two driving boards are combined as such, the impedance at the extended sustain electrodes is increased.

In order to solve such a problem, Korean Laid-Open Patent Publication No. 2003-90370 discusses a sustain pulse alternately having voltages Vs and −Vs being supplied only to the scan electrode while the sustain electrode is biased at a ground voltage during the sustain period.

However, since a capacitive component Cp is formed by the scan and sustain electrodes, a power loss of $\frac{1}{2}$ Cp $2Vs^2$ is generated when a voltage of the scan electrode is changed from the voltage −Vs (or Vs) to the voltage Vs (or −Vs). The power loss becomes $\{1/2Cp(Vs)^2+1/2Cp(Vs)^2\}$ when the voltage Vs is supplied alternately to the scan and sustain electrodes. Therefore, when the voltages Vs and −Vs are alternately supplied to the scan electrode during the sustain period, the power loss can be doubled in comparison to the case in which the voltage Vs is supplied alternately to the scan and sustain electrodes.

SUMMARY OF THE INVENTION

The present invention has been made in an effort to provide a plasma display and a driving method and circuit thereof having advantages of reducing a power loss during a sustain period.

One embodiment of the present invention provides a plasma display including: a plurality of first electrodes and a plurality of second electrodes adapted to control operation of the display; and a driving circuit adapted to alternately supply a second voltage that is greater than a first voltage and a third voltage that is less than the first voltage to the second electrodes upon the first voltage being supplied to the first electrodes during a sustain period; the driving circuit includes: a first power recovery unit including a first inductor having a first end coupled to the plurality of second electrodes; and a second power recovery unit including a second inductor having a first end coupled to the plurality of second electrodes, the second inductor having an inductance different from that of the first inductor; and the driving circuit is adapted to additionally increase a voltage of the second electrodes via the first inductor after the voltage of the second electrodes has been increased from the third voltage via the second inductor, and to additionally decrease the voltage of the second electrodes via the second inductor after the voltage of the second electrodes has been decreased from the second voltage via the first inductor.

The first power recovery unit preferably further includes a first switch coupled between a second end of the first inductor and a first power source and adapted to supply a fourth voltage having an amplitude between that of the first and second voltages, and a second switch coupled between the second end of the first inductor and the first power source: and the second power recovery unit preferably further includes a third switch coupled between a second end of the second inductor and a second power and adapted to supply a fifth voltage having an amplitude between that of the first and third voltages, and a fourth switch coupled between the second end of the second inductor and the second power.

The driving circuit preferably further includes at least one fifth switch coupled between a third power source adapted to supply the first voltage and the plurality of second electrodes; a sixth switch coupled between a fourth power source adapted to supply the second voltage and the plurality of second electrodes; and a seventh switch coupled between the fourth power source adapted to supply the second voltage and the plurality of second electrodes.

The at least one fifth switch preferably includes two transistors coupled back-to-back. The at least one fifth switch preferably includes a first diode and a first transistor coupled in series between the third power source and the plurality of second electrodes, and a second diode and a second transistor coupled in series between the third power source and the plurality of second electrodes.

A first path between the first inductor and the second electrodes preferably has a different length from that of a second path between the second inductor and the second electrodes; and a respective one of the first and second inductors on a longer path among the first and second paths preferably has a smaller inductance than that of a respective one of the first and second inductors on a shorter path among the first and second paths.

A difference in amplitude between the second and first voltages is preferably the same as a difference in amplitude between the first and third voltages.

Another embodiment of the present invention provides a plasma display including: a plurality of first electrodes adapted to receive a first voltage during a sustain period; a plurality of second electrodes adapted to control operation of the display along with the plurality of first electrodes; a first switch coupled between the plurality of second electrodes and a first power source, the first power source adapted to supply a second voltage having an amplitude greater than that of the first voltage; a second switch coupled between the plurality of second electrodes and a second power source, the second power source adapted to supply a third voltage having an amplitude less than that of the first voltage; at least one first inductor having a first end electrically coupled to the plurality of second electrodes; at least one second inductor having a first end electrically coupled to the plurality of second electrodes; a third power source electrically coupled to a second end of the first inductor and adapted to supply a fourth voltage having an amplitude between that of the first and second voltages; a fourth power source electrically coupled to a second end of the second inductor and adapted to supply a fifth voltage having an amplitude between that of the first and third voltages; a first rising path formed including the fourth power source, the second inductor, and the second electrodes and adapted to increase a voltage of the second electrodes from the third voltage; a second rising path including the third power source, the first inductor, and the second electrodes and adapted to increase the voltage of the second electrodes after having been increased by the first rising path; a first falling path including the second electrodes, the first inductor, and the third power source and adapted to reduce the voltage of the second electrodes from the second voltage; and a second falling path including the second electrodes, the second inductor, and the fourth power source and adapted to reduce the voltage of the second electrodes after having been decreased by the first falling path; the first inductor has an inductance different from that of the second inductor.

The plasma display preferably further includes: a third switch electrically coupled between the first inductor and the third power source of the second rising path; a fourth switch electrically coupled between the first inductor and the third power source of the first falling path; a fifth switch electrically coupled between the second inductor and the fourth power source of the first rising path; and a sixth switch electrically coupled between the second inductor and the fourth power source of the second falling path.

The plasma display preferably further includes a seventh switch coupled between a fifth power source adapted to supply the first voltage and the plurality of second electrodes.

A respective one of the first and second inductors on a longer path among the first and second paths preferably has a smaller inductance than that of a respective one of the first and second inductors on a shorter path among the first and second paths.

Still another embodiment of the present invention provides a method of driving a plasma display including a plurality of first electrodes and a plurality of second electrodes adapted to control operation of the display, the driving method including: alternately supplying a second voltage greater than a first voltage and a third voltage less than the first voltage to the second electrodes upon the first voltage being supplied to the first electrodes; decreasing a voltage of the second electrodes from the second voltage via a first inductor coupled to the plurality of second electrodes; additionally decreasing the voltage of the second electrodes via a second inductor coupled to the plurality of second electrodes; supplying the third voltage to the second electrodes; increasing the voltage of second electrodes from the third voltage via the second inductor; additionally increasing the voltage of the second electrodes via the first inductor; and supplying the second voltage to the second electrodes; the first inductor has an inductance different from that of the second inductor.

A first path between the first inductor and the second electrodes preferably has a length different from that of a second path between the second inductor and the second electrodes; and a respective one of the first and second inductors on a longer path among the first and second paths preferably has a smaller inductance than that of a respective one of the first and second inductors on a shorter path among the first and second paths.

The first voltage is preferably a ground voltage.

Yet another embodiment of the present invention provides a driving circuit for a plasma display including a plurality of first electrodes and a plurality of second electrodes adapted to control operation of the display, the driving circuit including: a first power recovery unit including a first inductor having a first end coupled to the plurality of second electrodes; and a second power recovery unit including a second inductor having a first end coupled to the plurality of second electrodes, the second inductor having an inductance different from that of the first inductor; the driving circuit is adapted to alternately supply a second voltage that is greater than a first voltage and a third voltage that is less than the first voltage to the second electrodes upon the first voltage being supplied to the first electrodes during a sustain period; and the driving circuit is adapted to additionally increase a voltage of the second electrodes via the first inductor after the voltage of the second electrodes has been increased from the third voltage via the second inductor, and to additionally decrease the voltage of the second electrodes via the second inductor after the voltage of the second electrodes has been decreased from the second voltage via the first inductor.

The first power recovery unit preferably further includes a first switch coupled between a second end of the first inductor and a first power source and adapted to supply a fourth voltage having an amplitude between that of the first and second voltages, and a second switch coupled between the second end of the first inductor and the first power source: and the second power recovery unit preferably further includes a third switch coupled between a second end of the second inductor and a second power and adapted to supply a fifth voltage having an amplitude between that of the first and third voltages, and a fourth switch coupled between the second end of the second inductor and the second power.

The driving circuit for a plasma display preferably further includes: at least one fifth switch coupled between a third power source adapted to supply the first voltage and the plurality of second electrodes; a sixth switch coupled between a fourth power source adapted to supply the second voltage and the plurality of second electrodes; and a seventh switch coupled between the fourth power source adapted to supply the second voltage and the plurality of second electrodes.

The at least one fifth switch preferably includes two transistors coupled back-to-back. The at least one fifth switch preferably includes a first diode and a first transistor coupled in series between the third power source and the plurality of second electrodes, and a second diode and a second transistor coupled in series between the third power source and the plurality of second electrodes.

A first path between the first inductor and the second electrodes preferably has a different length from that of a second path between the second inductor and the second electrodes; and a respective one of the first and second inductors on a longer path among the first and second paths preferably has a smaller inductance than that of a respective one of the first and second inductors on a shorter path among the first and second paths.

A difference in amplitude between the second and first voltages is preferably the same as a difference in amplitude between the first and third voltages.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
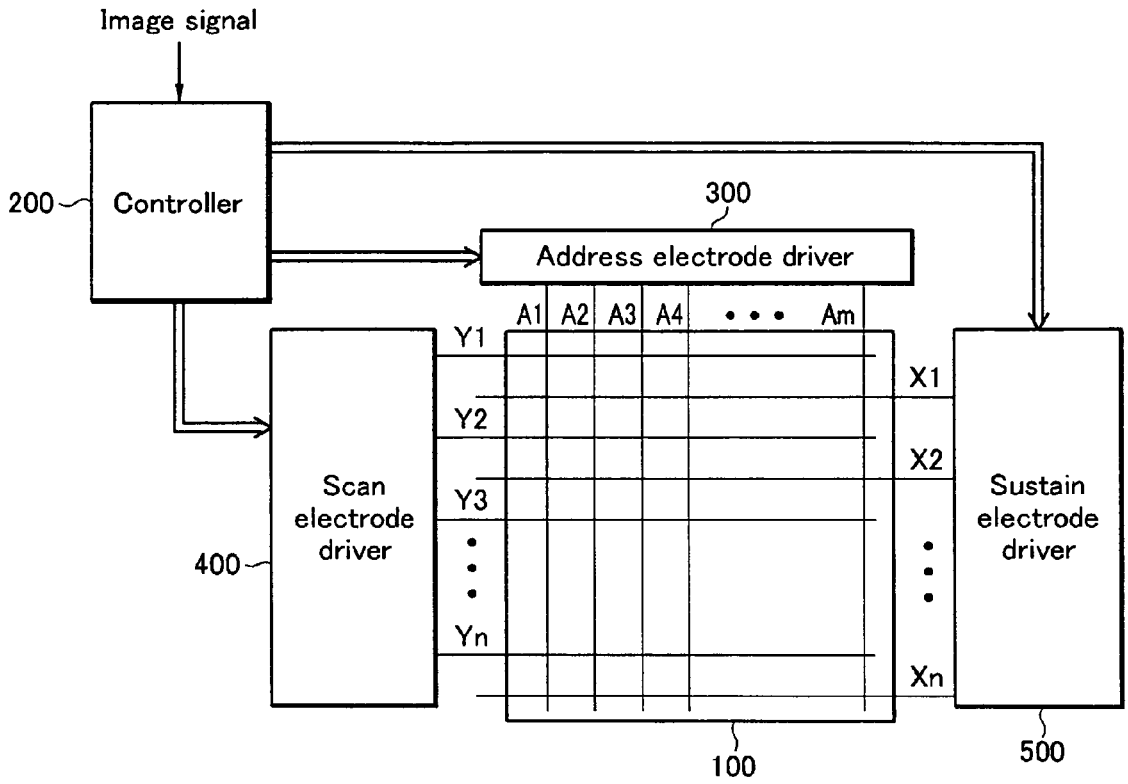
FIG. 1 is a view of a plasma display according to an exemplary embodiment of the present invention.

In the following detailed description, only certain exemplary embodiments of the present invention have been shown and described, simply by way of illustration. As those skilled in the art would realize, the described embodiments can be modified in various different ways, all without departing from the spirit or scope of the present invention. Accordingly, the drawings and description are to be regarded as illustrative in nature and not restrictive. Like reference numerals designate like elements throughout the specification. A coupled state of one element to another element includes a coupled state in which the two elements are directly coupled as well as a coupled state in which the two elements are coupled with another element provided between them.

Wall charges described in the present invention are charges formed on a wall close to each electrode of a discharge cell and accumulated on the electrode. The wall charges are described below as being "formed" or "accumulated" on the electrode, although the wall charges do not actually touch the electrodes. Furthermore, a wall voltage is a potential difference formed on the wall of the discharge cell by the wall charges.

A method of driving a PDP and a plasma display according to an embodiment of the present invention is also hereinafter described in detail with reference with the drawings.

FIG. 1 is a view of a plasma display according to an exemplary embodiment of the present invention.

As shown in FIG. 1, the plasma display includes a Plasma Display Panel (PDP) 100, a controller 200, an address electrode driver 300, a scan electrode driver 400, and a sustain electrode driver 500.

PDP 100 includes a plurality of address electrodes A1-Am (hereinafter referred to as A electrodes) extending in the column direction, and scan electrodes Y1-Yn (hereinafter referred to as Y electrodes) and sustain electrodes X1-Xn (hereinafter referred to as X electrodes) extending in the row direction. The respective X electrodes X1-Xn correspond to the respective Y electrodes Y1-Yn, and these X and Y electrodes perform a display operation for presenting an image during the sustain period. The Y electrodes Y1-Yn and the X electrodes X1-Xn respectively cross the A electrodes A1-An. A discharge cell (which hereinafter is simply called a cell) is formed by a discharge space formed at a crossing region of an address electrode A1-Am and a scan electrode Y1-Yn and a sustain electrode X1-Xn. This formation of the PDP 100 is an example, and another formation of a panel for supplying driving waveforms described below can be supplied to the present invention.

The controller 200 receives an external video signal and outputs an A electrode driving control signal, an X electrode driving control signal, and a Y electrode driving control signal, and controls the plasma display by dividing a frame into a plurality of subfields having respective brightness weight values. In addition, each subfield includes a reset period, an address period, and a sustain period according to time intervals.

The address electrode driver 300 receives the A electrode driving control signal from the controller 200, and supplies a driving voltage to the A electrodes.

The scan electrode driver 400 receives the Y electrode driving control signal from the controller 200, and supplies the driving voltage to the Y electrodes.

The sustain electrode driver 500 receives the sustain electrode driving control signal from the controller 200, and supplies the driving voltage to the X electrodes.

Figure 2:
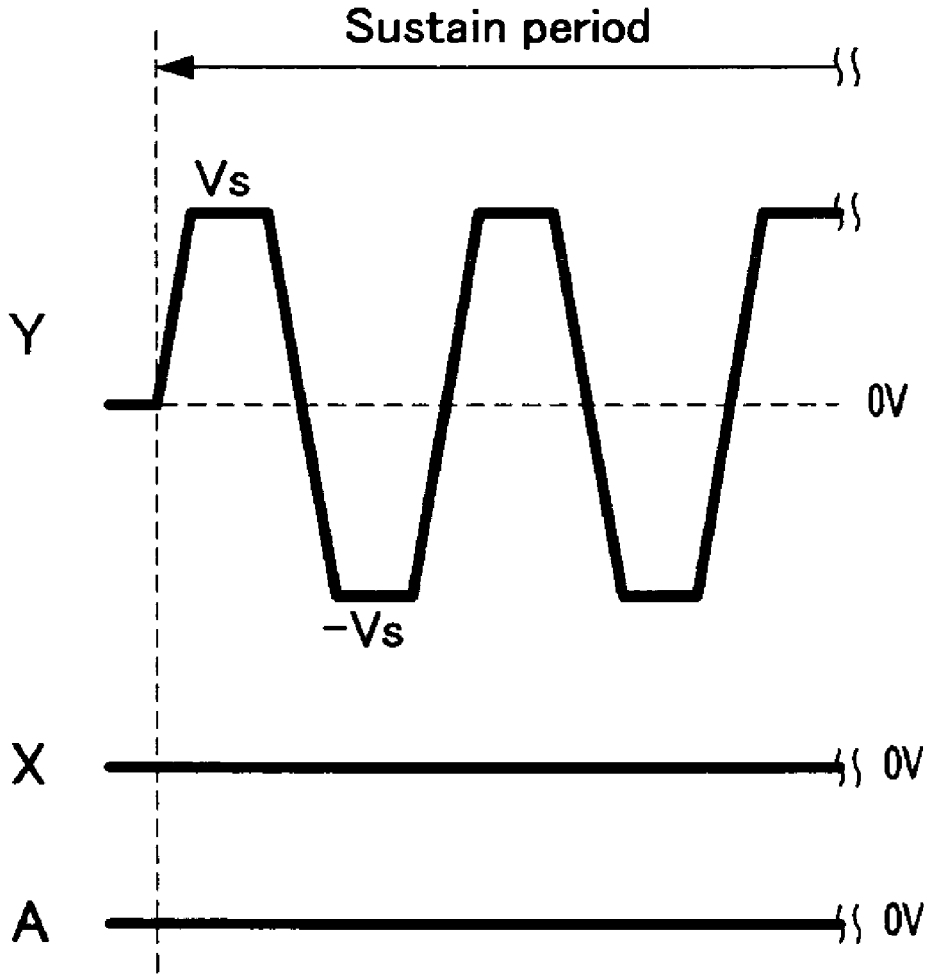
FIG. 2 is a view of driving waveforms of the plasma display according to the exemplary embodiment of the present invention.

Referring to FIG. 2, driving waveforms of the plasma display according to the exemplary embodiment of the present invention are described in more detail as follows. For a better understanding and ease of description, a driving waveform supplied to one cell formed of a Y electrode, an X electrode, and an A electrode is described below.

FIG. 2 is a view of driving waveforms of the plasma display according to the exemplary embodiment of the present invention. FIG. 2 is a view of a driving waveform of the sustain period.

As shown in FIG. 2, the sustain pulse alternately having voltages Vs and −Vs is supplied to the Y electrode while a 0V voltage is respectively supplied to the A and X electrodes during the sustain period. As a result, the sustain discharge pulse is supplied only by the scan electrode driver 400, and accordingly, the impedance on the path when the sustain discharge pulse is supplied is constant.

Generally, a wall voltage Vwxy is formed between the X and Y electrodes such that a potential of the Y electrode becomes higher than that of the X electrode at the selected cell to be turned on during the address period (not shown). Therefore, during the sustain period, the sustain pulse having a voltage Vs is first supplied to the Y electrode while a 0V voltage is respectively supplied to the A and X electrodes, and accordingly a sustain discharge is generated between the Y and X electrodes. The voltage Vs is set to be less than a discharge firing voltage between the Y and X electrodes and a voltage Vs+Vwxy is set to be greater than the discharge firing voltage. After the sustain discharge is generated, the (−) wall charges are formed on the Y electrode and the (+) wall charges are formed on the A and X electrodes. Accordingly, a wall voltage (Vwxy) is formed between the X and Y electrodes such that a potential of the X electrode becomes higher than that of the Y electrode.

Subsequently, the sustain pulse having a voltage −Vs is supplied to the Y electrode, and accordingly, the sustain discharge is generated between the Y and X electrodes. Therefore, the (+) wall charges are formed on the Y electrode and the (−) wall charges are formed on the X and A electrodes such that another sustain discharge can be generated by supplying the voltage Vs to the Y electrode. Subsequently, the process of alternately supplying the sustain discharge pulses of voltages Vs and −Vs to the scan electrode Y is repeated a number of times corresponding to a weight value of a corresponding subfield.

A driving circuit for supplying the sustain pulse during the sustain period is described in more detail below with reference to FIG. 3. An N-channel Field Effect Transistor (FET) having a body diode is used as a switch, However, another switch for performing the same or similar functions can alternatively be used. Furthermore, a capacitive component formed by the X electrode and the Y electrode is denoted as a panel capacitor Cp.

Figure 3:
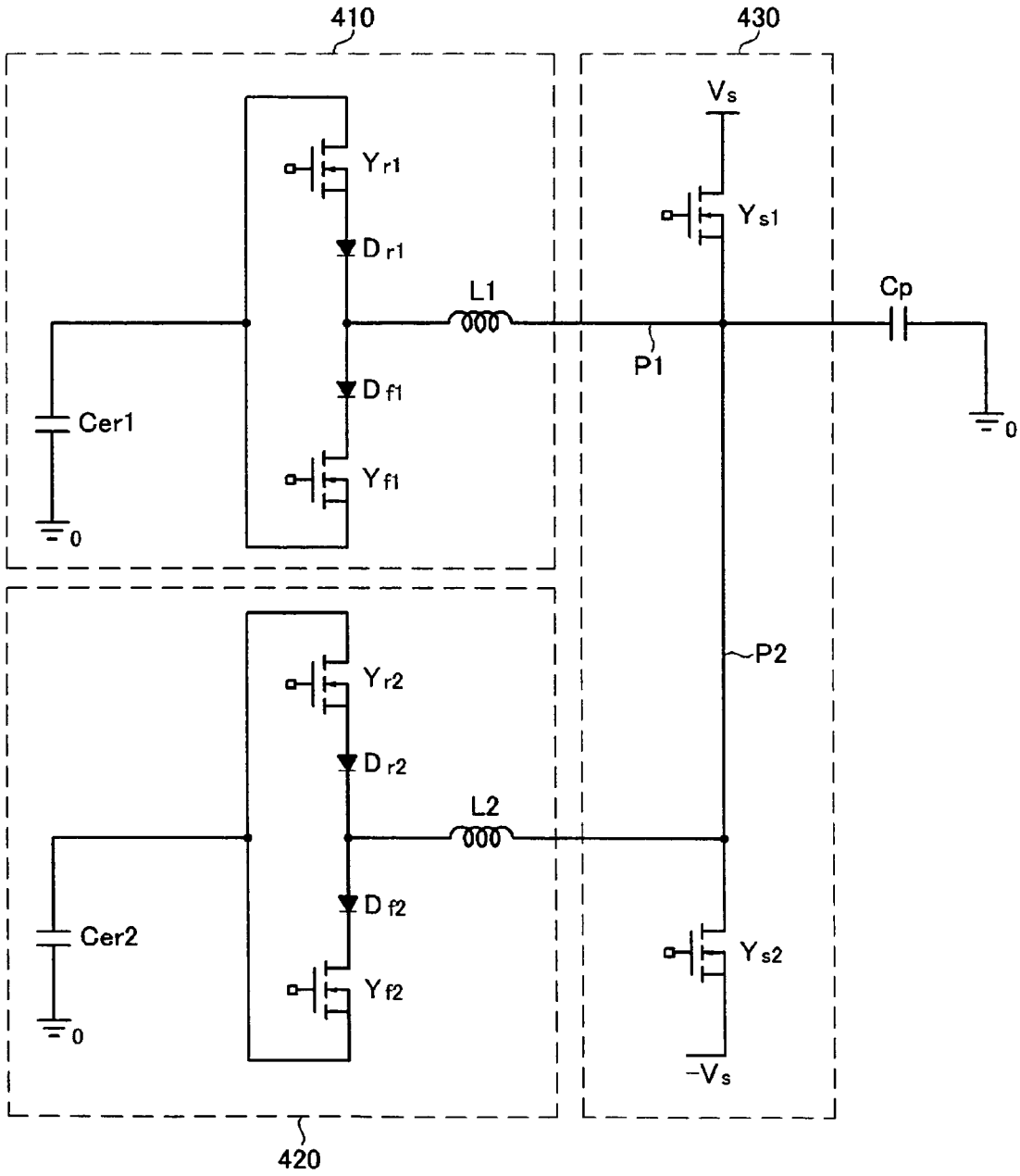
FIG. 3 is a circuit diagram of a sustain discharge driving circuit of a sustain electrode driver according to a first exemplary embodiment of the present invention.

FIG. 3 is a circuit diagram of a sustain discharge driving circuit of a scan electrode driver according to a first exemplary embodiment of the present invention.

As shown in FIG. 3, the sustain discharge driving circuit of the scan electrode driver 400 according to an exemplary embodiment of the present invention includes first and second power recovery units 410 and 420 and a voltage supply 430.

The first recovery unit 410 includes transistors Yr1 and Yf1, an inductor L1, diodes Dr1 and Df1, and a capacitor Cer1, and the second recovery unit 420 includes transistors Yr2 and Yf2, an inductor L2, diodes Dr2 and Df2, and a capacitor Cer2.

The power recovery capacitor Cer1 is coupled between a drain of the transistor Yr1 and a source of the transistor Yf1, and the power recovery capacitor Cer2 is coupled between a drain of the transistor Yr2 and a source of the transistor Yf2. In addition, a Y electrode of the panel capacitor Cp is coupled to a first end of the inductor L1, and a second end of the inductor L1 is coupled between a source of the transistor Yr1 and a drain of the transistor Yf1, while a Y electrode of the panel capacitor Cp is coupled to a first end of the inductor L2, and a second end of the inductor L2 is coupled between a source of the transistor Yr2 and a drain of the transistor Yf2. A diode Dr1 is coupled between the source of the transistor Yr1 and the inductor L1, and a diode Df1 is coupled between the source of the transistor Yf1 and the inductor L1. In addition, a diode Dr2 is coupled between the source of the transistor Yr2 and the inductor L2, and a diode Df2 is coupled between the source of the transistor Yf2 and the inductor L2. The capacitor Cer1 is charged to a voltage Vs/2, and the capacitor Cer1 is charged to a voltage −Vs/2.

The diodes Dr1 and Dr2 set an increasing path for increasing a voltage of the panel capacitor Cp when the transistors Yr1 and Yr2 have a body diode, and the diodes Df1 and Df2 set a decreasing path for decreasing a voltage of the Y electrode when the transistors Yf1 and Yf2 have a body diode. The diodes Dr1, Df1, Dr2, and Df2 can be eliminated when the transistor Yr and the transistors Yr1, Yr2, Yf1, and Yf2 do not have body diodes. The first power recovery unit 410 increases the voltage of the Y electrode from 0V to the voltage Vs or decreases the voltage of the Y electrode from the voltage Vs to 0V using the resonance of the inductor L1 and the panel capacitor Cp, and the second power recovery unit 420 increases the voltage of the Y electrode from the voltage −Vs to 0V or decreases the voltage of the Y electrode from 0V to the voltage −Vs using the resonance of the inductor L2 and the panel capacitor Cp.

In addition, in the power recovery unit 410, the connection order of the inductor L1, the diode Df1, and the transistor Yf1 can be changed, and the connection order of the inductor L1, the diode Dr1, and the transistor Yr1 can also be changed. For example, the inductor L1 can be coupled between a node of the transistors Yr1 and Yf1 and the power recovery capacitor Cer1. Likewise, in the power recovery unit 420, the connection order of the inductor L2, the diode Df2, and the transistor Yf2 can be changed, and the connection order of the inductor L2, the diode Dr2, and the transistor Yr2 can also be changed. In addition, the inductor L1 is coupled to the node of the transistors Yr1 and Yf1 in FIG. 3, but the inductors can be respectively coupled to the increasing path formed by the transistor Yr1 and the decreasing path formed by the transistor Yf1. This method can also be applied to the second recovery unit 420.

The voltage supply 430 includes transistors Ys1 and Ys2.

The transistor Ys1 is coupled between a power source Vs for supplying a voltage Vs and the Y electrode of the panel capacitor Cp, and the transistor Ys2 is coupled between a power source −Vs for supplying a voltage −Vs and the Y electrode of the panel capacitor Cp. The two transistors Ys1 and Ys2 respectively supply the voltage Vs and −Vs to the Y electrode.

The time-variant operation of a sustain discharge driving circuit during the sustain period according to the first embodiment of the present invention is described in more detail below with reference to FIG. 4, FIG. 5A, and FIG. 5B. The time-variant operation is sequentially performed from a mode 1 (M1) to a mode 6 (M6), and the mode can be changed from one to another by an operation of a transistor. In the following description, the term inductance-capacitance (LC) resonance is used. It should be understood that the term LC resonance does not necessarily refer to the infinite behavior of oscillation, but is used to specify the curve or pattern according to which the behavior of a voltage will follow during an increase or a decrease thereof by the combination of the inductors L1 and L2 and the panel capacitor Cp when the transistors Yr1, Yr2, Yf1, and Yf2 turn on.

Figure 4:
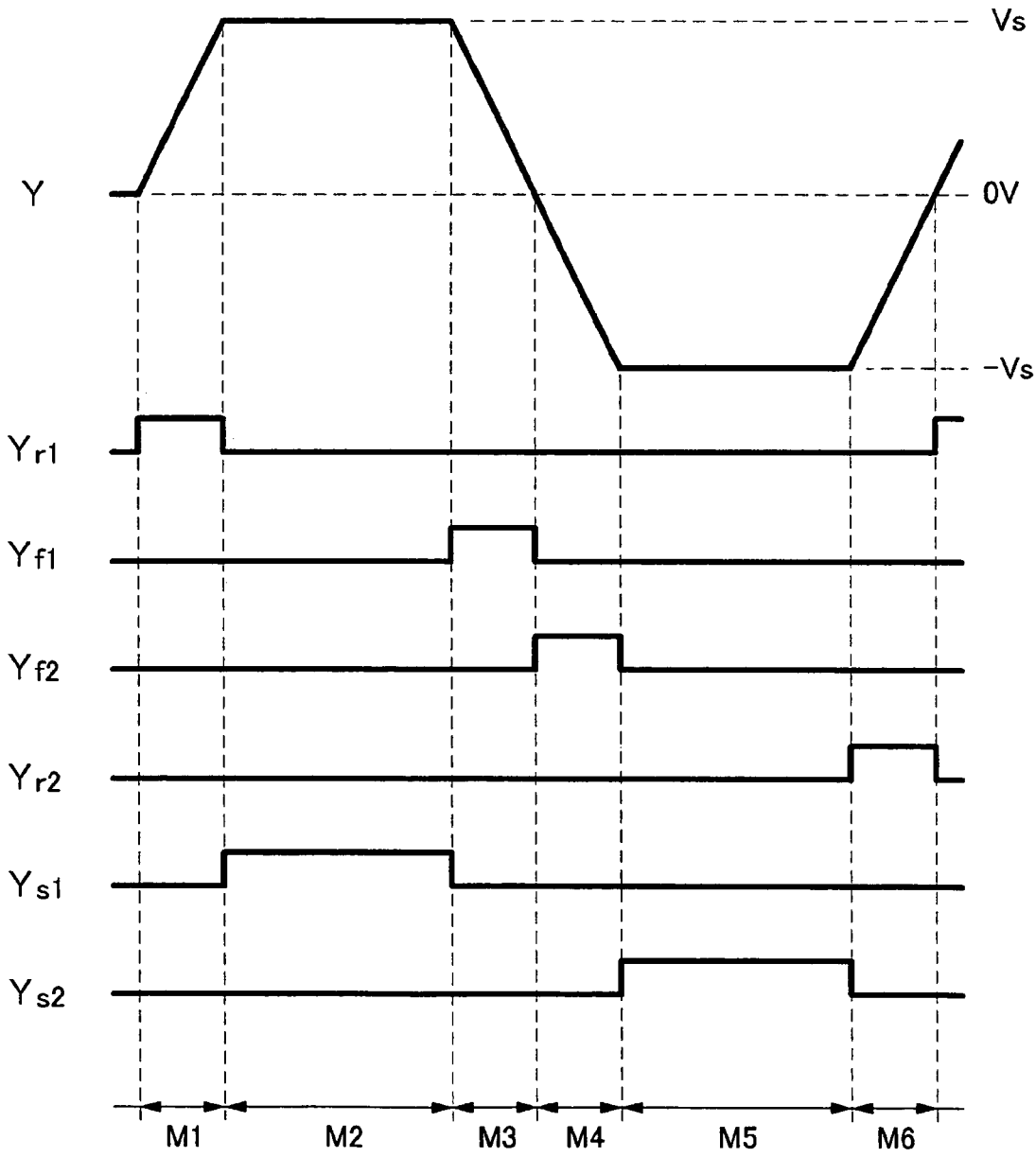
FIG. 4 is a view of the driving timing of the driving circuit of FIG. 3.
Figure 5A:
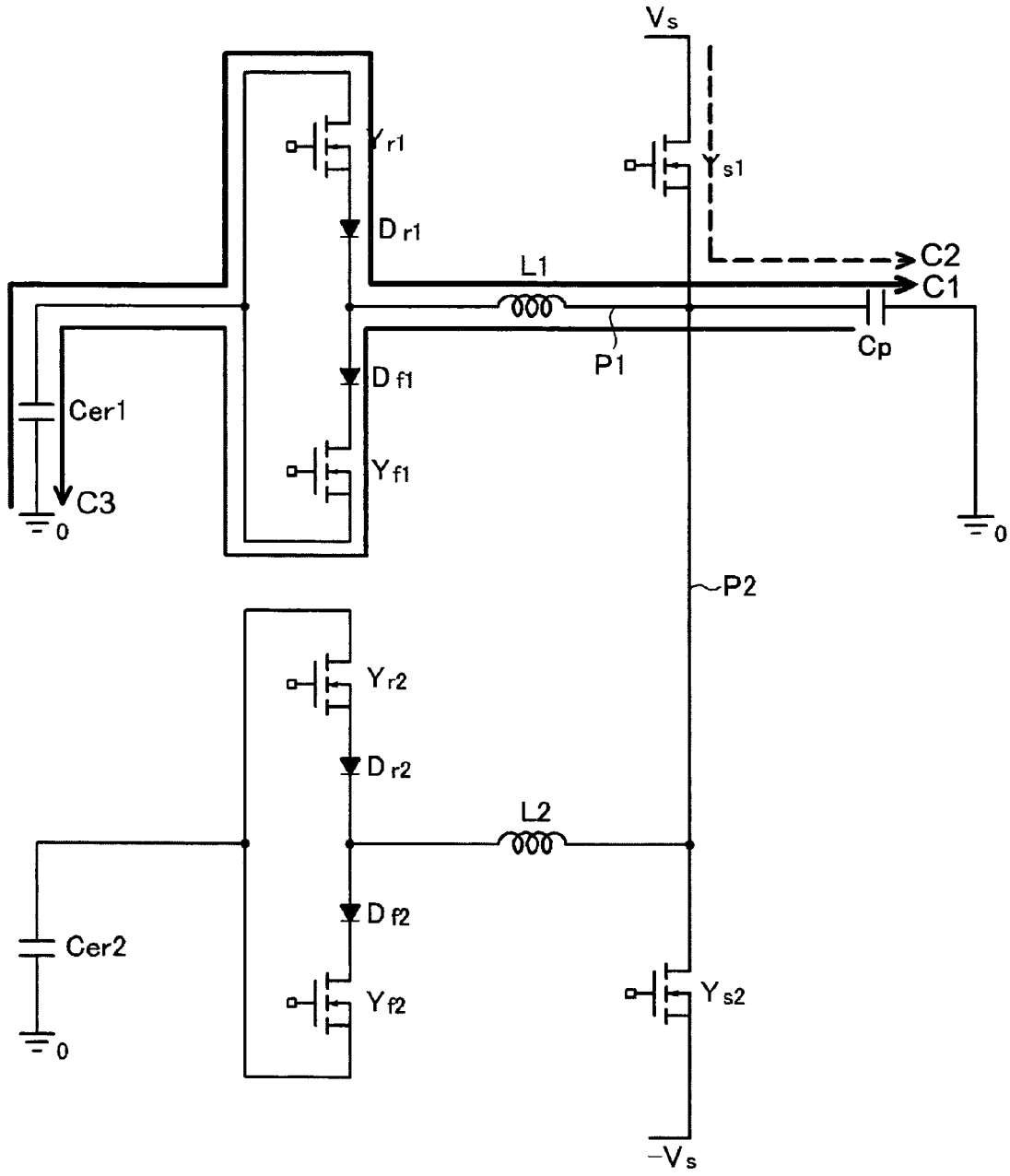
FIG. 5A and FIG. 5B are respective views of a current path at the respective modes of the driving circuit of FIG. 3.
Figure 5B:
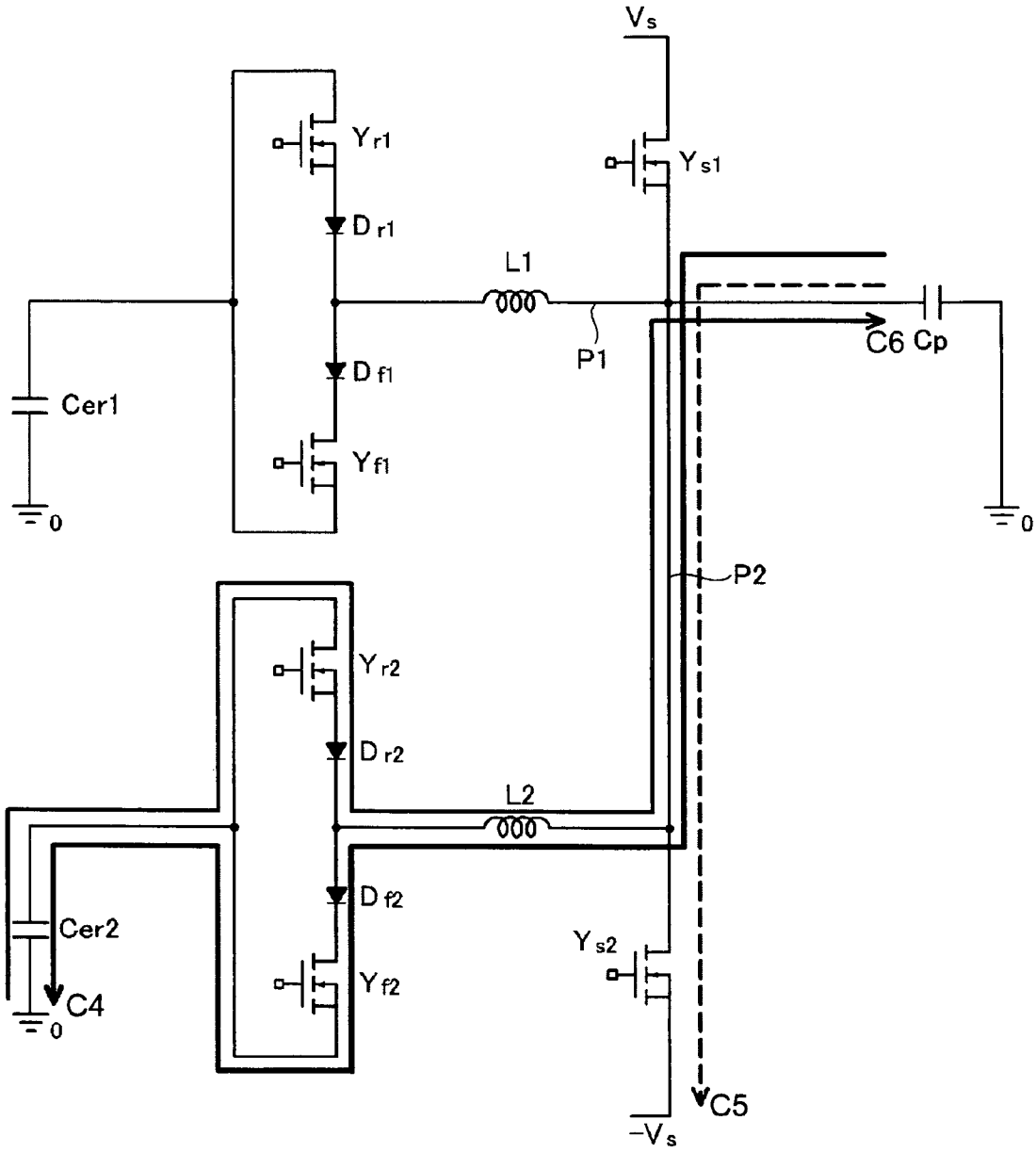

FIG. 4 is a view of the driving timing of the driving circuit of FIG. 3, and FIG. 5A and FIG. 5B are respective views of a current path at the respective modes of the driving circuit of FIG. 3.

It is assumed that a 0V voltage is supplied to the Y electrode of the panel capacitor Cp before a mode 1 (M1) starts.

At the mode 1 (M1), the transistor Yr1 is turned-on. Then, a current path C1 is formed through the power recovery capacitor Cer1, the transistor Yr1, the diode Dr1, and the inductor L1, to the Y electrode of the panel capacitor Cp. An LC resonance is generated between the inductor L1 and the panel capacitor Cp by the current path C1. A voltage at the Y electrode of the panel capacitor Cp increases almost to the voltage of Vs since the power recovery capacitor Cer1 is charged to a voltage Vs/2.

In a mode 2 (M2), the transistor Ys1 is turned-on and the transistor Yr1 is turned-off. Then, a current path C2 is formed from the power source Vs through the transistor Ys1 to the Y electrode of the panel capacitor Cp, as shown in FIG. 5A. The Y electrode is supplied with the voltage Vs by the current path.

In a mode 3 (M3), the transistor Yf1 is turned-on and the transistor Ys1 is turned-off. Then, a current path C3 is formed from the Y electrode of the panel capacitor Cp through the inductor L1, the diode Df1, the transistor Yf1, and the power recovery capacitor Cer1 as shown in FIG. 5A. An LC resonance is generated between the inductor L1 and the panel capacitor Cp by the current path C3. The voltage charged at the Y electrode of the panel capacitor Cp is discharged such that the voltage of the Y electrode of the panel capacitor Cp is decreased almost to 0V according to the LC resonance characteristic curve.

In a mode 4 (M4), the transistor Yf2 is turned-on and the transistor Yf1 is turned-off. Then, current path C4 is formed from the Y electrode of the panel capacitor Cp through the inductor L2, the diode Df2, and the transistor Yf2 to the capacitor Cer2, as shown in FIG. 5B. An LC resonance is generated between the inductor L2 and the panel capacitor Cp by the current path C4. The voltage charged at the Y electrode of the panel capacitor Cp is discharged such that the voltage of the Y electrode of the panel capacitor Cp is decreased almost to the voltage —Vs according to the LC resonance characteristic curve.

In a mode 5 (M5), the transistor Ys2 is turned-on and the transistor Yf2 is turned-off. Then, a current path C5 is formed from the Y electrode of the panel capacitor Cp through the transistor Ys2 to the power source −Vs, and the voltage −Vs is supplied to the Y electrode of the panel capacitor.

In a mode 6 (M6), the transistor Yr2 is turned-on and the transistor Ys2 is turned-off. Then, a current path C6 is formed from the capacitor Cer2 through the transistor Yf2, the diode Df2, and the inductor L2 to the Y electrode of the panel capacitor Cp, as shown in FIG. 5B. An LC resonance is generated between the inductor L2 and the panel capacitor Cp by the current path C6. A voltage at the Y electrode of the panel capacitor Cp increases almost to 0V since the power recovery capacitor Cer1 is charged to a voltage −Vs/2.

The sustain discharge driving circuit supplies the sustain pulse alternately having the voltages Vs and −Vs to the Y electrode by the current repeatedly flowing through the modes 1 to 6 (M1-M6).

In addition, the power loss become $\{1/2Cp(Vs)^2+1/2Cp(Vs)^2\}$ when these two power recovery circuits 410 and 420 are used as described above. Therefore, the power loss can be reduced compared to the power loss $1/2Cp\ 2Vs^2$ caused when the voltages Vs and −Vs are alternately supplied to the Y electrode.

As shown FIG. 3, when the power recovery circuits 410 and 420 are separated and the voltages Vs and −Vs are supplied to the Y electrode in the sustain discharge driving circuit of the scan electrode driver 400, one path (in FIG. 3, refer to the path P2 connected between the panel capacitor Cp and the inductor L2) can be formed longer due to an interruption of the periphery elements when circuit elements are arranged on the board. For example, the path P2 between the panel capacitor Cp and the inductor L2 can be formed longer than a path P1 between the panel capacitor Cp and the inductor L1, and accordingly a parasitic inductance on the path P2 is increased. When the inductors L1 and L2 have the same inductance, the impedance on the path P2 can become greater than the impedance on the path P1 due to the parasitic inductance.

However, when the resonance occurs between the inductor and the capacitor, a resonance current is in proportion to an inverse of a square root of the inductance $$L\left(\frac{1}{\sqrt{L}}\right),$$

and accordingly, the resonance current of the path P2 becomes less than that of the path P1. Therefore, the voltage of the Y electrode of the panel capacitor Cp cannot be decreased almost to the voltage −Vs in the mode 4 (M4) because of other parasitic components formed in the path P2. Then, an over-current can be generated due to the abrupt change of the voltage when the transistor Ys2 coupled to the power source for supplying the voltage −Vs is turned on. Stress on the circuit elements is caused by the over-current, resulting in over-heating of the circuit elements which can then be damaged.

Therefore, when the two separated power recovery circuits 410 and 420 are driven in the sustain discharge driving circuit of the scan electrode driver 400 according to the first exemplary embodiment of the present invention, the panel capacitor Cp and the inductors L1 and L2 are differently set on the path P1 or P2 according to the length of the paths P1 and P2.

In more detail, the inductance of the inductor L2 on a longer path (in FIG. 3, the path P2 formed by the panel capacitor Cp and the inductor L2) is set to be smaller than the inductance of the inductor L1 on a shorter path (in FIG. 3, the path P1 formed by the panel capacitor Cp and the inductor L2). Then, the impedance can be compensated for by the parasitic inductances. In addition, it is but one example that the path P2 is longer than the path P1. Accordingly, the path P1 can be longer than the path P2 according to arrangements of the driving circuit. The inductance of the inductor L1 on the path P1 can be set to be less than that of the inductor L2 on the path 2.

In the sustain discharge driving circuit according to the first exemplary embodiment of the present invention, a sustain discharge pulse is supplied to the Y electrode using only the resonance without supplying a 0V voltage to the Y electrode. With such an arrangement, a waveform of the sustain discharge pulse can be deformed. In more detail, when the voltage of the Y electrode is decreased from the voltage Vs to a 0V voltage using the resonance, the voltage of the Y electrode is decreased from the voltage Vs almost to a 0V voltage rather than to a 0V voltage due to the noise components on the respective paths. Thereafter, when the voltage of the Y electrode is again decreased to the voltage −Vs using the resonance, the voltage of the Y electrode cannot be decreased to the voltage −Vs because the voltage of the previous Y electrode is not decreased exactly to a 0V voltage. Using only the resonance as such, a waveform of the sustain discharge pulse can be deformed. Therefore, when a 0V voltage is respectively supplied to the Y electrode after the voltage of the Y electrode is decreased from the voltage Vs almost to a 0V voltage using the resonance and after the voltage of the Y electrode is increased from the voltage −Vs almost to a 0V voltage using the resonance 0V, the waveform of the sustain discharge pulse cannot be deformed compared to that of the first exemplary embodiment. A driving circuit that is capable of generating such a driving waveform is described in detail below with reference to FIG. 6 and FIG. 7.

Figure 6:
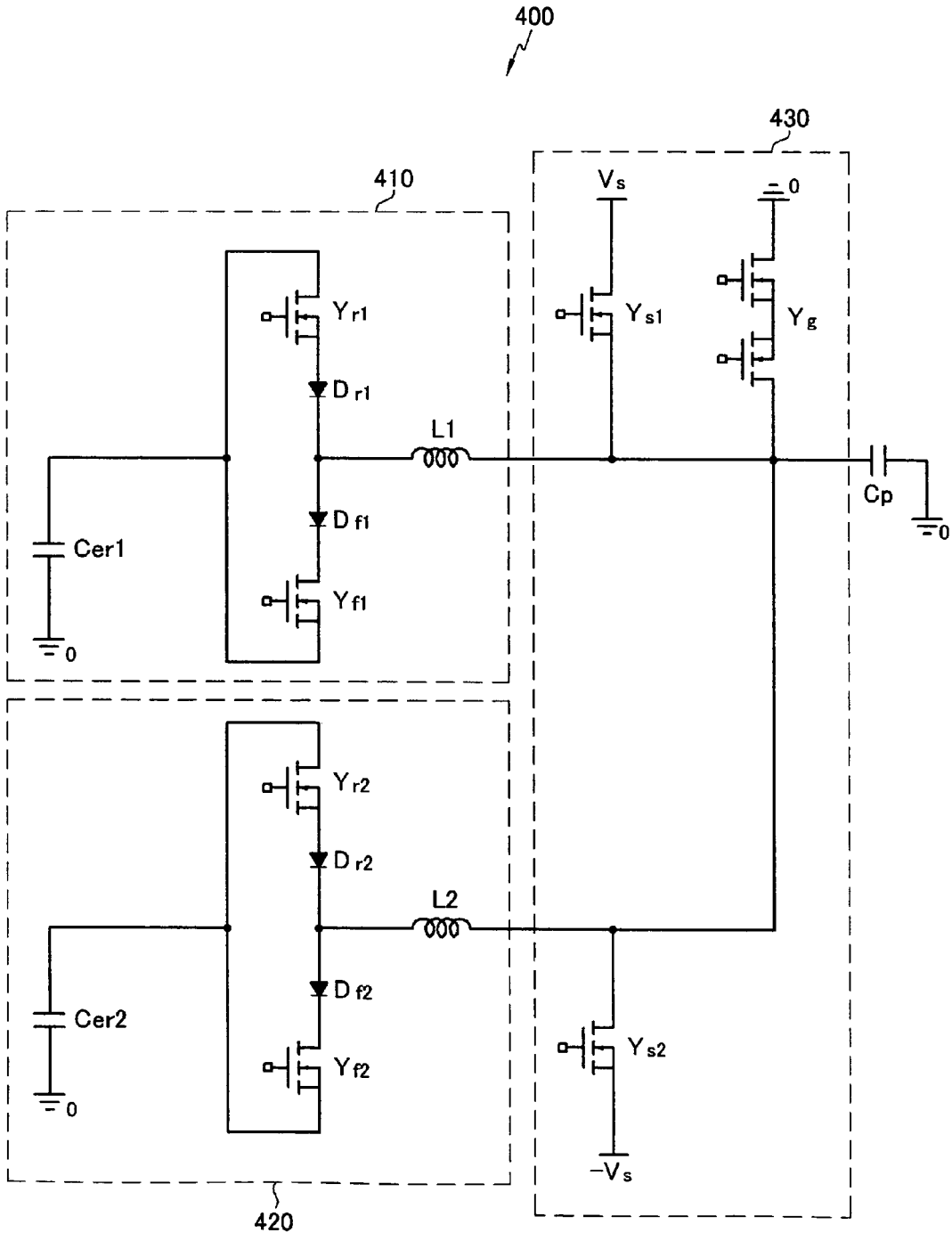
FIG. 6 is a circuit diagram of a sustain discharge driving circuit of a sustain electrode driver according to a second exemplary embodiment of the present invention.
Figure 7:
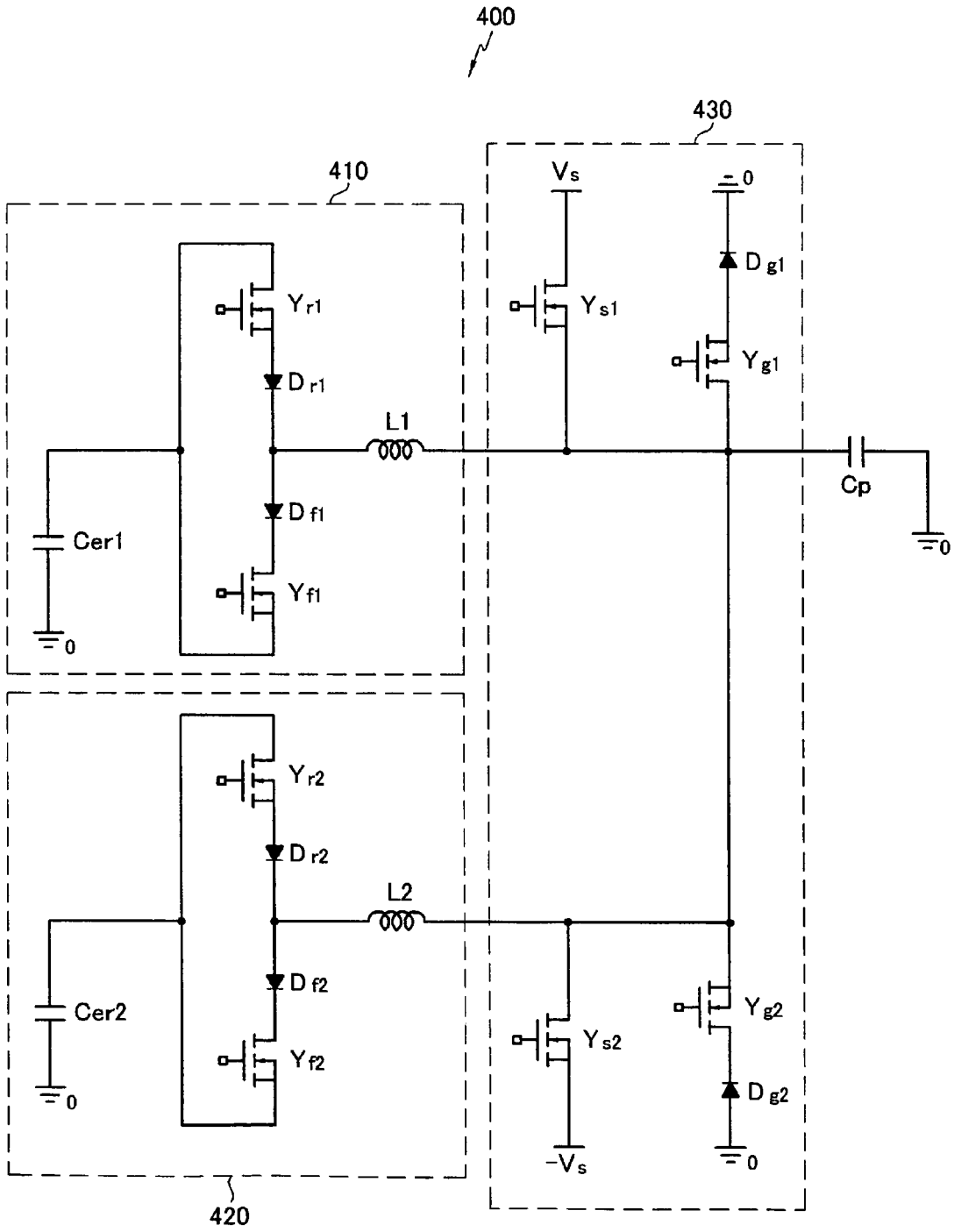
FIG. 7 is a circuit diagram of a sustain discharge driving circuit of a sustain electrode driver according to a third exemplary embodiment of the present invention.

FIG. 6 is a circuit diagram of a sustain discharge driving circuit according to a second exemplary embodiment of the present invention. FIG. 7 is a circuit diagram of a sustain discharge driving circuit according to a third exemplary embodiment of the present invention.

As shown in FIG. 6, the voltage supply 430 further includes a transistor Yg. The transistor Yg is coupled between the Y electrode of the panel capacitor Cp and a 0V power source for supplying a 0V voltage, and is formed in a back-to-back format so as to intercept a path of current flowing through the body diode. When the transistor Yg has no body diode, the transistor Yg can be formed in a back-to-back format.

In such a driving circuit, the transistor Yg is turned-on and 0V is supplied to the Y electrode of the panel capacitor Cp after the voltage of the Y electrode is decreased almost to a 0V voltage using the resonance in the mode 3 (M3), and the transistor Yg is turned-on and 0V is supplied to the Y electrode of the panel capacitor Cp after the voltage of the Y electrode is increased almost to a 0V voltage using the resonance in the mode 6 (M6).

In such a driving circuit, stress on the transistor Yg can occur because the transistor Yg coupled to a 0V voltage is excessively turned on/off so as to supply a 0V voltage to the Y electrode. Therefore, as shown in FIG. 7, the transistor Yg can be divided into two transistors Yg1 and Yg2 rather than formed in a back-to-back format. In more detail, the voltage supply 430 further includes transistors Yg1 and Yg2 and diodes Dg1 and Dg2. The transistor Yg1 having a drain coupled to a first end of the inductor L1 is coupled between the Y electrode of the panel capacitor Cp and a 0V voltage, and the transistor Yg2 having a source coupled to a first end of the inductor L2 is coupled between the Y electrode of the panel capacitor Cp and a 0V voltage. In addition, the diode Dg1 is coupled inversely with respect to the body diode so as to intercept the path of current flowing through the body diode of the transistor Yg1. Likewise, the diode Dg2 is coupled inversely with respect to the body diode so as to intercept the path of current flowing through the body diode of the transistor Yg2. When the transistors Yg1 and Yg2 have no body diode, the diodes Dg1 and Dg2 can be deleted.

In such a driving circuit, the transistor Yg1 is turned on after the mode 3 (M3), and the transistor Yg2 is turned on after the mode 6 (M6), and accordingly a 0V voltage is supplied to the Y electrode of the panel capacitor Cp. In this manner, when a 0V voltage is supplied to the Y electrode, the on/off operation of the transistors Yg1 and Yg2 can be decreased in comparison with the transistor Yg of the second exemplary embodiment.

While the present invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims.

According to an exemplary embodiment of the present invention, when the voltages Vs and −Vs is alternately supplied to either the scan electrode or the sustain electrode during the sustain period, the power loss can be reduced by half by using two separated power recovery circuits. In addition, when the inductances of the inductors on the two power recovery circuit paths are differently controlled and the impedance is compensated for by the parasitic inductances on the longer path, the power recovery circuit can have enhanced efficiency and can be prevented from over-heating and stress of the circuit elements.

What is claimed is:

1. A plasma display, comprising:

a plurality of first electrodes and a plurality of second electrodes adapted to control operation of the display; and a driving circuit adapted to alternately supply a second voltage that is greater than a first voltage and a third voltage that is less than the first voltage to the second electrodes upon the first voltage being supplied to the first electrodes during a sustain period;

wherein the driving circuit includes:

a first power recovery unit including a first inductor having a first end coupled to the plurality of second electrodes; and a second power recovery unit including a second inductor having a first end coupled to the plurality of second electrodes, the second inductor having an inductance different from that of the first inductor;

and wherein the driving circuit is adapted to additionally increase a voltage of the second electrodes via the first inductor after the voltage of the second electrodes has been increased from the third voltage via the second inductor, and to additionally decrease the voltage of the second electrodes via the second inductor after the voltage of the second electrodes has been decreased from the second voltage via the first inductor.

2. The plasma display of claim 1, wherein the first power recovery unit further comprises a first switch coupled between a second end of the first inductor and a first power source and adapted to supply a fourth voltage having an amplitude between that of the first and second voltages, and a second switch coupled between the second end of the first inductor and the first power source: and wherein the second power recovery unit further comprises a third switch coupled between a second end of the second inductor and a second power source and adapted to supply a fifth voltage having an amplitude between that of the first and third voltages, and a fourth switch coupled between the second end of the second inductor and the second power source.

3. The plasma display of claim 2, wherein the driving circuit further comprises at least one fifth switch coupled between a third power source adapted to supply the first voltage and the plurality of second electrodes;

a sixth switch coupled between a fourth power source adapted to supply the second voltage and the plurality of second electrodes; and a seventh switch coupled between the fourth power source adapted to supply the second voltage and the plurality of second electrodes.

4. The plasma display of claim 3, wherein the at least one fifth switch comprises two transistors coupled back-to-back.

5. The plasma display of claim 3, wherein the at least one fifth switch comprises a first diode and a first transistor coupled in series between the third power source and the plurality of second electrodes, and a second diode and a second transistor coupled in series between the third power source and the plurality of second electrodes.

6. The plasma display of claim 1, wherein:

a first path between the first inductor and the second electrodes has a different length from that of a second path between the second inductor and the second electrodes; and a respective one of the first and second inductors on a longer path among the first and second paths has a smaller inductance than that of a respective one of the first and second inductors on a shorter path among the first and second paths.

7. The plasma display of claim 6, wherein a difference in amplitude between the second and first voltages is the same as a difference in amplitude between the first and third voltages.

8. A plasma display, comprising:

a plurality of first electrodes adapted to receive a first voltage during a sustain period;

a plurality of second electrodes adapted to control operation of the display along with the plurality of first electrodes;

a first switch coupled between the plurality of second electrodes and a first power source, the first power source adapted to supply a second voltage having an amplitude greater than that of the first voltage;

a second switch coupled between the plurality of second electrodes and a second power source, the second power source adapted to supply a third voltage having an amplitude less than that of the first voltage;

at least one first inductor having a first end electrically coupled to the plurality of second electrodes;

at least one second inductor having a first end electrically coupled to the plurality of second electrodes;

a third power source electrically coupled to a second end of the first inductor and adapted to supply a fourth voltage having an amplitude between that of the first and second voltages;

a fourth power source electrically coupled to a second end of the second inductor and adapted to supply a fifth voltage having an amplitude between that of the first and third voltages;

a first rising path formed including the fourth power source, the second inductor, and the second electrodes and adapted to increase a voltage of the second electrodes from the third voltage;

a second rising path including the third power source, the first inductor, and the second electrodes and adapted to increase the voltage of the second electrodes after having been increased by the first rising path;

a first falling path including the second electrodes, the first inductor, and the third power source and adapted to reduce the voltage of the second electrodes from the second voltage; and a second falling path including the second electrodes, the second inductor, and the fourth power source and adapted to reduce the voltage of the second electrodes after having been decreased by the first falling path;

wherein the first inductor has an inductance different from that of the second inductor.

9. The plasma display of claim 8, further comprising:

a third switch electrically coupled between the first inductor and the third power source of the second rising path;

a fourth switch electrically coupled between the first inductor and the third power source of the first falling path;

a fifth switch electrically coupled between the second inductor and the fourth power source of the first rising path; and a sixth switch electrically coupled between the second inductor and the fourth power source of the second falling path.

10. The plasma display of claim 9, further comprising a seventh switch coupled between a fifth power source adapted to supply the first voltage and the plurality of second electrodes.

11. The plasma display of claim 8, wherein a respective one of the first and second inductors on a longer path among the first and second paths has a smaller inductance than that of a respective one of the first and second inductors on a shorter path among the first and second paths.

12. A method of driving a plasma display including a plurality of first electrodes and a plurality of second electrodes adapted to control operation of the display, the driving method comprising:

alternately supplying a second voltage greater than a first voltage and a third voltage less than the first voltage to the second electrodes upon the first voltage being supplied to the first electrodes;

decreasing a voltage of the second electrodes from the second voltage via a first inductor coupled to the plurality of second electrodes;

additionally decreasing the voltage of the second electrodes via a second inductor coupled to the plurality of second electrodes;

supplying the third voltage to the second electrodes;

increasing the voltage of second electrodes from the third voltage via the second inductor;

additionally increasing the voltage of the second electrodes via the first inductor; and supplying the second voltage to the second electrodes;

wherein the first inductor has an inductance different from that of the second inductor.

13. The method of claim 12, wherein:

a first path between the first inductor and the second electrodes has a length different from that of a second path between the second inductor and the second electrodes; and a respective one of the first and second inductors on a longer path among the first and second paths has a smaller inductance than that of a respective one of the first and second inductors on a shorter path among the first and second paths.

14. The method of claim 12, wherein the first voltage is a ground voltage.

15. The method of claim 13, wherein the first voltage is a ground voltage.

* * * * *